US010095139B2

(12) United States Patent
Saito et al.

(10) Patent No.: US 10,095,139 B2
(45) Date of Patent: Oct. 9, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yutaka Saito, Kanagawa (JP); Fusako Kiyono, Kanagawa (JP); Mona Tasaki, Kanagawa (JP); Hiroki Omori, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,191

(22) Filed: Aug. 2, 2016

(65) Prior Publication Data

US 2017/0242354 A1 Aug. 24, 2017

(30) Foreign Application Priority Data

Feb. 19, 2016 (JP) ..... 2016-029981

(51) Int. Cl.

| | |
|---|---|
| ***G03G 9/097*** | (2006.01) |
| ***G03G 9/08*** | (2006.01) |
| ***G03G 9/107*** | (2006.01) |
| ***G03G 15/08*** | (2006.01) |
| ***G03G 15/01*** | (2006.01) |

(52) U.S. Cl.

CPC ..... *G03G 9/08* (2013.01); *G03G 9/0819* (2013.01); *G03G 9/1075* (2013.01); *G03G 15/0126* (2013.01); *G03G 15/0865* (2013.01); *G03G 15/0189* (2013.01); *G03G 2215/0132* (2013.01)

(58) Field of Classification Search

CPC ..... G03G 9/09708; G03G 9/09783; G03G 9/09791

See application file for complete search history.

(56) References Cited

U.S. PATENT DOCUMENTS

| | | | | |
|---|---|---|---|---|
| 2006/0068311 | A1* | 3/2006 | Kim | G03G 9/0872 430/108.11 |
| 2008/0056769 | A1* | 3/2008 | Iizuka | G03G 9/10 399/252 |
| 2009/0067894 | A1* | 3/2009 | Yamada | G03G 9/1075 399/302 |
| 2010/0196817 | A1* | 8/2010 | Sasaki | G03G 9/0819 430/109.4 |
| 2015/0212443 | A1* | 7/2015 | Shibata | G03G 9/08755 430/105 |

FOREIGN PATENT DOCUMENTS

| | | |
|---|---|---|
| JP | 2010-060645 A | 3/2010 |
| JP | 2013-156470 A | 8/2013 |

* cited by examiner

*Primary Examiner* — Peter L Vajda
(74) *Attorney, Agent, or Firm* — Oliff PLC

(57) ABSTRACT

An electrostatic charge image developing toner includes a toner particle, a polishing agent particle, and a fatty acid metal salt particle, wherein a rate of the fatty acid metal salt particles strongly attached to the surface of the toner particles is equal to or greater than 50% by number with respect to the fatty acid metal salt particles attached to the surface of the toner particles.

12 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-029981 filed Feb. 19, 2016.

BACKGROUND

1. Technical Field

The present invention relates to an electrostatic charge image developing toner, an electrostatic charge image developer, and a toner cartridge.

2. Related Art

In the electrophotographic image forming, a toner is used as an image forming material, and a toner containing toner particles containing a binder resin and a colorant, and an external additive which is externally added to the toner particles is often used, for example.

SUMMARY

According to an aspect of the invention, there is provided an electrostatic charge image developing toner including:

a toner particle;

a polishing agent particle; and a fatty acid metal salt particle, wherein a rate of the fatty acid metal salt particles strongly attached to the surface of the toner particles is equal to or greater than 50% by number with respect to the fatty acid metal salt particles attached to the surface of the toner particles.

BRIEF DESCRIPTION OF THE DRAWINGS

Exemplary embodiments of the present invention will be described in detail based on the following figures, wherein.

DETAILED DESCRIPTION

Figure 1:
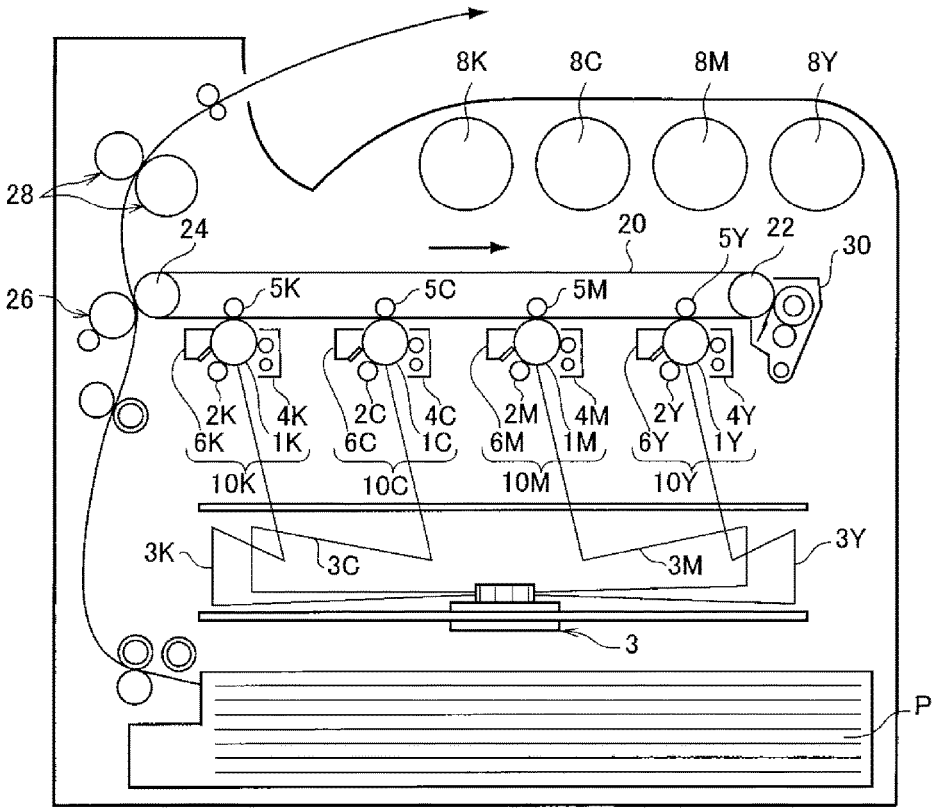
FIG. 1 is a schematic configuration diagram showing an image forming apparatus according to the exemplary embodiment.

Hereinafter, exemplary embodiments which are examples of the invention will be described.

Electrostatic Charge Image Developing Toner

An electrostatic charge image developing toner (also simply referred to a "toner") according to the embodiment includes toner particles, polishing agent particles, and fatty acid metal salt particles.

A rate of toner particles to a surface of which the fatty acid metal salt particles are attached (hereinafter, also referred to as a "rate of fatty acid metal salt-attached toner particles") is equal to or greater than 30% by number with respect to the entirety of toner particles, and a rate of the fatty acid metal salt particles strongly attached to the surface of the toner particles (hereinafter, also referred to as a "strong attachment rate of fatty acid metal salt particles") is equal to or greater than 50% by number with respect to the fatty acid metal salt particles attached to the surface of the toner particles.

with the toner according to the embodiment having the configuration described above, occurrence of fogging (a phenomenon in which a toner is attached to a non-image portion) is prevented when an image is printed in a high temperature and high humidity (for example, 28.5° C. and 85% RH) environment, after images having high image density (for example, equal to or greater than 30%) are continuously printed in a low temperature and low humidity (for example, 10° C. and 15% RH) environment. The reason thereof is assumed as follows.

In the related art, when attachment materials such as discharge products generated from a charging unit are attached to a surface of an image holding member of an image forming apparatus, sensitivity of the image holding member may decrease and image defects such as color spots or color streaks may be formed. Thus, a technology of removing attachment materials such as discharge products attached to the surface of the image forming apparatus and preventing image defects such as color spots or color streaks, by using a toner containing toner particles and polishing agent particles has been known.

However, in a case where a two-component developer containing a toner containing toner particles and polishing agent particles, and a carrier in which a surface of magnetic particles is coated with a resin coating layer is used, a mechanical load such as stirring is continuously applied to the developer in a developing unit, when images having high image density is continuously printed in the low temperature and low humidity environment. Thus, a large amount of polishing agent particles is moved to the surface of the carrier and a phenomenon in which the resin coating layer of the carrier is polished, may occur. When the resin coating layer of the carrier is polished, charging ability of the carrier decreases and this easily causes low charging of a developer in the high temperature and high humidity environment. Accordingly, when images are printed in the high temperature and high humidity environment, fogging easily occurs.

Therefore, the toner contains fatty acid metal salt particles together with the toner particles and the polishing agent particles, under the conditions that the rate of fatty acid metal salt-attached toner particles and the strong attachment rate of fatty acid metal salt particles satisfy the ranges described above.

Here, a state where the fatty acid metal salt particles are contained in the toner under the conditions indicates a state where an appropriate amount of fatty acid metal salt particles is attached to the surface of the toner particles, and the fatty acid metal salt particles attached to the surface of the toner particles are hardly isolated, even when a mechanical load is received.

That is, even when a mechanical load such as stirring is continuously received in a developing unit, the fatty acid metal salt particles easily come into contact with the carrier in a state of being attached to the surface of the toner particles, without being isolated from the surface of the toner particles. When the fatty acid metal salt particles come into contact with the carrier due to a mechanical load, the fatty acid metal salt particles cause cleavage due to pressure or a frictional force caused by the toner particles and the carrier, and a coating film of the fatty acid metal salt particles is formed on a surface of the carrier (surface of the resin coating layer).

Accordingly, even when images having high image density are continuously printed in the low temperature and low humidity environment and a large amount of polishing agent particles is moved to the surface of the carrier in the developing unit, the polishing of the resin coating layer of the carrier by the polishing agent particles is prevented due to lubricity of a v coating film formed on the surface of the resin coating layer of the carrier. Therefore, a decrease in charging ability of the carrier is prevented and low charging of a developer in the high temperature and high humidity environment is prevented.

Generally, in a normal toner containing fatty acid metal salt particles, the fatty acid metal salt particles are easily isolated from toner particles, supplied to an image holding member due to a centrifugal force and an development field of a developing member (magnetic roll or the like) in a developing unit, and is hardly moved to a surface of a carrier. Thus, in the normal toner, a coating film of fatty acid metal salt is hardly formed on a surface of a carrier (surface of a resin coating layer) by using the fatty acid metal salt particles.

As described above, with the toner according to the embodiment, it is assumed that occurrence of fogging (a phenomenon in which a toner is attached to a non-image portion) is prevented when an image is printed in the high temperature and high humidity environment, after images having high image density are continuously printed in the low temperature and low humidity environment.

Here, the rate of fatty acid metal salt-attached toner particles (rate of toner particles to a surface of which the fatty acid metal salt particles are attached) is equal to or greater than 30% by number with respect to the entirety of toner particles, and is preferably equal to or greater than 40% by number and more preferably equal to or greater than 50% by number, from a viewpoint of prevention of occurrence of fogging. The rate of fatty acid metal salt-attached toner particles is preferably equal to or less than 90% by number, from a viewpoint of regulation in a preparing method, and is preferably equal to or less than 80% by number and more preferably equal to or less than 70% by number, from a viewpoint of realization of high resistance due to an excessive amount of attachment of fatty acid metal salt particles to the carrier.

When the rate of fatty acid metal salt-attached toner particles is set to be equal to or greater than 30% by number, a coating amount of fatty acid metal salt formed on the surface (surface of the resin coating layer) of the carrier due to cleavage of fatty acid metal salt particles becomes sufficient, and polishing of the resin coating layer of the carrier due to the polishing agent particles is prevented. As a result, occurrence of fogging is prevented.

The strong attachment rate of fatty acid metal salt particles (rate of the fatty acid metal salt particles strongly attached to the surface of the toner particles with respect to the fatty acid metal salt particles attached to the surface of the toner particles) is equal to or greater than 50% by number, and is preferably equal to or greater than 55% by number and more preferably equal to or greater than 60% by number, from a viewpoint of prevention of occurrence of fogging. The upper limit value of the strong attachment rate of fatty acid metal salt particles is not particularly limited, but the strong attachment rate of fatty acid metal salt particles may be equal to or less than 80% by number, from a viewpoint of a decrease in adhesiveness to the carrier.

When the strong attachment rate of fatty acid metal salt particles is equal to or greater than 50% by number, the isolation of the fatty acid metal salt particles from the surface of the toner particles due to a mechanical load such as stirring in a developing unit is prevented, and supply of an excessive amount of the isolated fatty acid metal salt particles to an image holding member due to a centrifugal force and an development field of a developing member (magnetic roll or the like) is prevented. Therefore, a coating amount of fatty acid metal salt formed on the surface (surface of the resin coating layer) of the carrier due to cleavage of fatty acid metal salt particles becomes sufficient, and polishing of the resin coating layer of the carrier due to the polishing agent particles is prevented. As a result, occurrence of fogging is prevented.

As a method of setting the rate of fatty acid metal salt-attached toner particles and the strong attachment rate of fatty acid metal salt particles to be in the ranges, respectively, a method of attaching fatty acid metal salt particles to a surface of toner particles by using a shear force is used. This method is preferable, because fatty acid metal salt particles are strongly attached to the toner particles with a small mechanical load to the toner particles. As a device used in this method, NOBILTA (for example, NOBILTA NOB130 manufactured by Hosokawa Micron Corporation) is used. NOBILTA is a stirring device which performs stirring while applying high pressure to particles by narrowing a free space (clearance) for putting particles. In NOBILTA, the rate of fatty acid metal salt-attached toner particles and the strong attachment rate of fatty acid metal salt particles are adjusted in accordance with a width of clearance and stirring rotation rate.

In addition to the method described above, a method of increasing adhesiveness of an external additive to a surface of toner particles by applying heat to the toner after the external adding, is also used, as the method of setting the rate of fatty acid metal salt-attached toner particles and the strong attachment rate of fatty acid metal salt particles to be in the ranges, respectively.

The rate of fatty acid metal salt-attached toner particles and the strong attachment rate of fatty acid metal salt particles are values measured by the following method.

First, the following first pretreatment is performed with respect to a toner which is a measurement target.

10 g of a toner is dispersed in 40 ml of an aqueous solution having 0.2% by weight of a surfactant. This is stirred at 500 rpm for 30 seconds by using a magnetic stirrer and a stirring bar. After that, the mixture is put in a 50 mL sedimentation tube-attached centrifuge separator to perform separation of toner at 10,000 rpm for 2 minutes and remove a supernatant, and then, drying is performed at room temperature (25° C.) for 24 hours to obtain a toner subjected to the first pretreatment.

Then, the rate of fatty acid metal salt-attached toner particles is measured by the following method using the toner subjected to the first pretreatment. In the following observation of the toner subjected to the first pretreatment, toner particles observed to be contacted or overlapped with the fatty acid metal salt particles are assumed as toner particles to which the fatty acid metal salt particles are attached.

100 toner particles which are measurement targets are observed with a scanning electron microscope (SEM). The rate of toner particles to a surface of which the fatty acid metal salt particles are attached is calculated. The SEM observation of 100 toner particles which are measurement targets is performed using ERA-8900 manufactured by Elionix Inc.

Meanwhile, the strong attachment rate of fatty acid metal salt particles is measured by the following method using the toner subjected to the first pretreatment.

The following second pretreatment of removing the weakly attached fatty acid metal salt particles is further performed with respect to the toner subjected to the first pretreatment. 10 g of a toner is dispersed in 40 ml of an aqueous solution having 0.2% by weight of a surfactant and subjected to ultrasonic vibration at output of 60 W and frequency of 20 kHz for 1 hour by using an ultrasonic homogenizer US300T (manufactured by NISSEI Corporation). After that, the mixture is put in a 50 mL sedimentation tube-attached centrifuge separator to perform separation of toner at 10,000 rpm for 2 minutes and remove a supernatant, and then, drying is performed at room temperature (25° C.) for 24 hours to obtain a toner subjected to the second pretreatment.

The toner subjected to the first pretreatment and the toner subjected to the second pretreatment are subjected to fluorescence X-ray measurement to measure Net intensity of metal elements (zinc, magnesium, aluminum, calcium, barium, and the like) contained in the fatty acid metal salt particles. A value obtained by dividing the Net intensity of the toner subjected to the second pretreatment by the Net intensity of the toner subjected to the first pretreatment and multiplying a resultant value by 100 (Net intensity of toner subjected to second pretreatment/Net intensity of toner subjected to first pretreatment×100) is set as the strong attachment rate of fatty acid metal salt particles. The fluorescence X-ray measurement is performed with a fluorescence X-ray device, and in this embodiment, XRF1500 which is a fluorescence X-ray measurement device manufactured by Shimadzu Corporation.

Hereinafter, the toner according to the embodiment will be described in detail.

The toner according to the embodiment includes toner particles and an external additive.

Toner Particles

The toner particles contain a binder resin. The toner particles may contain a colorant, and a release, and other additives, if necessary.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used alone or in combination of two or more kinds thereof.

As the binder resin, a polyester resin is suitable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K 7121-1987 "Testing Methods for Transition Temperature of Plastics".

The weight average molecular weight (Mw) of the polyester resin is preferably from 5,000 to 1,000,000 and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100 and more preferably from 2 to 60.

The weight average molecular weight and the number average molecular weight are measured by gel permeation chromatography (GPC). The molecular weight measurement by GPC is performed by using GPC.HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably from 40% by weight to 95% by weight, more preferably from 50% by weight to 90% by weight, and even more preferably from 60% by weight to 85% by weight with respect to a total amount of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is preferably from 1% by weight to 30% by weight, more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C. and more preferably from 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the total toner particles.

Other Additives

Examples of other additives include known additives such a charge-controlling agent and an inorganic particle. The toner particles include these additives as internal additives.

Characteristics of Toner Mother Particles

The toner mother particles may be toner mother particles having a single-layer structure, or toner mother particles having a so-called core/shell structure composed of a core part (core particle) and a coating layer (shell layer) coated on the core part.

Here, toner mother particles having a core/shell structure is preferably composed of, for example, a core part containing a binder resin, and if necessary, other additives such as a colorant and a release agent and a coating layer containing a binder resin.

The volume average particle diameter ($D_{50v}$) of the toner mother particles is preferably from 2 μm to 10 μm, and more preferably from 4 μm to 8 μm.

Various average particle diameters and various particle size distribution indices of the toner mother particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter $D_{16v}$ and a number average particle diameter $D_{16p}$, while the particle diameter when the cumulative percentage becomes 50% is defined as that corresponding to a volume average particle diameter $D_{50v}$ and a number average particle diameter $D_{50p}$. Furthermore, the particle diameter when the cumulative percentage becomes 84% is defined as that corresponding to a volume average particle diameter $D_{84v}$ and a number average particle diameter $D_{84p}$.

Using these, a volume particle size distribution index (GSDv) is calculated as $(D_{84v}/D_{16v})^{1/2}$, while a number particle size distribution index (GSDp) is calculated as $(D_{84p}/D_{16p})^{1/2}$.

The shape factor SF1 of the toner particles is preferably from 110 to 150, and more preferably from 120 to 140.

The shape factor SF1 is obtained through the following expression.

Expression: $$SF1=(ML^2/A)\times(\pi/4)\times 100$$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

The external additive contains the polishing agent particles and fatty acid metal salt particles. The external additive may contain other external additives. That is, only the polishing agent particles and fatty acid metal salt particles may be externally added to the toner particles or the polishing agent particles, fatty acid metal salt particles, and other external additives may be externally added to the toner particles.

Polishing Agent Particles

The polishing agent particles are not particularly limited and examples thereof include inorganic particles such as metal oxides such as cerium oxide, magnesium oxide, aluminum oxide (alumina), zinc oxide, or zirconia; carbides such as silicon carbide; nitrides such as boron nitride; pyrophosphate such as calcium pyrophosphate particles; carbonate such as calcium carbonate or barium carbonate; and metal titanate particles such as barium titanate, magnesium titanate, calcium titanate, or strontium titanate. The polishing agent particles may be used alone or in combination of two or more kinds thereof. Among these, as the polishing agent particles, particles of metal titanate are preferable, and strontium titanate particles are more preferable, from viewpoints of a function, availability, and cost of the polishing agent.

The surface of the polishing agent particles may be treated with a hydrophobizing agent, for example. As the hydrophobizing agent, a well-known organic silicon compound including an alkyl group (for example, a methyl group, an ethyl group, a propyl group, or a butyl group) is used, and specific examples thereof include silane compounds (for example, such as methyltrimethoxysilane, dimethyldimethoxysilane, trimethylchlorosilane, or trimethylmethoxysilane), silazane compounds (for example, such as hexamethyldisilazane, or tetramethyldisilazane). The hydrophobizing agent may be used alone or in combination of two or more kinds thereof.

A number average particle diameter of the polishing agent particles is preferably from 2 μm to 10 μm and more preferably from 3 μm to 7 μm, from a viewpoint of prevention of formation of color spots and color streaks caused by attachment materials of an image holding member. The number average particle diameter thereof is even more preferably from 4 μm to 6 μm.

The number average particle diameter of the polishing agent particles is a value measured by the following method.

First, the toner which is a measurement target is observed with a scanning electron microscope (SEM). An equivalent circle diameter each of 100 polishing agent particles which are measurement targets is calculated by image analysis, and an equivalent circle diameter in number cumulative 50% (50-th) from the small diameter side in the distribution based on a volume is set as a number average particle diameter.

In the image analysis for determining equivalent circle diameters of 100 polishing agent particles which are measurement targets, a two-dimensional image is captured at magnification of 10,000 using an analysis device (ERA-8900 Elionix Inc.), a projected areas are determined under the conditions of 0.010000 μm/pixel using image analysis software WINROOF (manufactured by Mitani Corporation), and equivalent circle diameters are determined using an equation: equivalent circle diameter=$2\sqrt{(\text{projected area}/\pi)}$.

The distinction of the fatty acid metal salt particles and the polishing agent particles is performed by the following method. The toner is dispersed in an aqueous solution obtained by adding a surfactant to water having specific gravity adjusted to be from 1.5 to 2.0 by dissolving potassium iodide or the like. Then, by keeping the dispersion for 24 hours, toner particles and fatty acid metal salt particles having specific gravity less than that of the aqueous solution are separated to an upper portion of the aqueous solution, and the polishing agent particles having specific gravity greater than that of the aqueous solution is precipitated in a lower portion of the aqueous solution. The toner particles and the fatty acid metal salt particles separated to the upper portion of the aqueous solution are collected, and a sample obtained by drying the collected solution at room temperature (25° C.) is observed by SEM observation, and particles having a particle diameter equal to or greater than 0.1 μm excluding the toner particles are set as fatty acid metal salt particles. The particles precipitated in the lower portion of the aqueous solution are set as polishing agent particles. The polishing agent particles are dried and taken out, and a number average particle diameter of the polishing agent particles is measured by using the method described above.

In a case where the polishing agent particles are determined separately or collected from a toner, the determined or collected polishing agent particles are set as measurement targets, and the measurement described above is performed.

The content (amount externally added) of the polishing agent particles is preferably from 0.01% by weight to 5% by weight, more preferably from 0.02% by weight to 2% by weight, and even more preferably from 0.05% by weight to 1.5% by weight, and most preferably from 0.1% by weight to 1% by weight, with respect to the toner particles.

Fatty Acid Metal Salt Particles

The fatty acid metal salt particles are particles of salt formed of fatty acid and metal.

Fatty acid may be any one of saturated fatty acid or unsaturated fatty acid. As the fatty acid, fatty acid having 10 to 25 carbon atoms (preferably 12 to 22 carbon atoms) is used. The carbon number of fatty acid is a value containing the number of carbon atoms of a carboxylic group.

Examples of fatty acid include unsaturated fatty acid such as behenic acid, stearic acid, palmitic acid, myristic acid, or lauric acid; or unsaturated fatty acid such as oleic acid, linoleic acid, or ricinoleic acid. Among these fatty acid, stearic acid and lauric acid are preferable and stearic acid is more preferable.

As the metal, divalent metal may be used. Examples of metal include magnesium, calcium, aluminum, barium, and zinc. Among these, zinc is preferable as the metal.

Examples of fatty acid metal salt particles include particles of metal salt of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, or sodium stearate; metal salt of palmitic acid such as zinc palmitate, cobalt palmitate, copper palmitate, magnesium palmitate, aluminum palmitate, or calcium palmitate; metal salt of lauric acid such as zinc laurate, manganese laurate, calcium laurate, iron laurate, magnesium laurate, or aluminum laurate; metal salt of oleic acid such as zinc oleate, manganese oleate, iron oleate, aluminum oleate, copper oleate, magnesium oleate, or calcium oleate; metal salt of linoleic acid such as zinc linoleate, cobalt linoleate, or calcium linoleate; and metal salt of ricinoleic acid such as zinc ricinoleate or aluminum ricinoleate.

Among these, as the fatty acid metal salt particles, particles of metal salt of stearic acid or metal salt of lauric acid are preferable, particles of zinc stearate or zinc laurate are more preferable, and zinc stearate particles are even more preferable.

A method of preparing the fatty acid metal salt particles is not particularly limited, and examples thereof include a method of performing cationic substitution of fatty acid alkali metal salt; a method of directly causing a reaction between fatty acid and metal hydroxide; and the like.

When a method of preparing the zinc stearate particles as the fatty acid metal salt particles is used as an example, examples the method include a method of performing cationic substitution of sodium stearate; a method of causing a reaction between stearic acid and zinc hydroxide; and the like.

The number average particle diameter of the fatty acid metal salt particles is preferably from 0.5 μm to 3.0 μm and more preferably from 1.0 μm to 2.5 μm, from a viewpoint of prevention of occurrence of fogging. Particularly, when the number average particle diameter of the fatty acid metal salt particles is in the range of 0.5 μm to 3.0 μm, the rate of fatty acid metal salt-attached toner particles and the strong attachment rate of fatty acid metal salt particles easily increase and occurrence of fogging is easily prevented.

The number average particle diameter of the fatty acid metal salt particles is a value measured by the same method as that of the number average particle diameter of the polishing agent particles.

Here, a ratio ($D_f/D_t$) of the number average particle diameter $D_f$ of the fatty acid metal salt particles and the volume average particle diameter $D_t$ of the toner particles is preferably from 0.05 to 1.0, more preferably from 0.1 to 0.8, and even more preferably from 0.2 to 0.7, from a viewpoint of prevention of occurrence of fogging.

When the ratio ($D_f/D_t$) is in the range of 0.05 to 1.0, the rate of fatty acid metal salt-attached toner particles and the strong attachment rate of fatty acid metal salt particles easily increase and occurrence of fogging is easily prevented.

The content (amount externally added) of the fatty acid metal salt particles is preferably from 0.02 parts by weight to 5 parts by weight, more preferably from 0.05 parts by weight to 3.0 parts by weight, and even more preferably from 0.08 parts by weight to 1.0 parts by weight, with respect to 100 parts by weight of the toner particles.

The weight ratio of the fatty acid metal salt particles and a polishing agent particle is preferably from 1:40 to 20:1.

Other External Additives

Examples of the other external additives include inorganic particles having a number average particle diameter equal to or less than 1 μm (preferably equal to or less than 500 nm) (hereinafter, also referred to as "inorganic particles having a small diameter"). The number average particle diameter of the inorganic particles having a small diameter is a value measured by the same method as that of the number average particle diameter of the polishing agent particles.

Examples of the inorganic particles having a small diameter include $SiO_2$, $TiO_2$, CuO, $SnO_2$, $Fe_2O_3$, BaO, CaO, $K_2O$, $Na_2O$, $CaO.SiO_2$, $K_2O.(TiO_2)n$, $Al_2O_3.2SiO_2$, $MgCO_3$, $BaSO_4$, and $MgSO_4$.

The surfaces of the inorganic particles having a small diameter used as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles having a small diameter.

Examples of the other external additives also include resin particles (resin particles such as polystyrene, polymethyl methacrylate (FMMA), and melamine resin) and a cleaning aid (e.g., fluorine polymer particles).

The amount of the other external additives externally added is, for example, preferably from 0.01% by weight to 5% by weight, and more preferably from 0.01% by weight to 2.0% by weight with respect to the toner particles.

Other Embodiments of Toner

In the toner according to the embodiment, among the toner particles to the surface of which the fatty acid metal salt particles are attached, a rate of toner particles having a particle diameter equal to or smaller than the volume average particle diameter (particle diameter when the cumulative percentage becomes 50%, by drawing cumulative distributions by volume from the side of the smallest diameter) is preferably from 40% by number to 70% by number with respect to the entirety of toner particles. Accordingly, fixation of a toner to an image holding member (toner filming) is prevented when an image having a low image density (for example, equal to or smaller than 5%) is printed, after images having high image density (for example, equal to or greater than 30%) are continuously printed in a low temperature and low humidity (for example, 10° C. and 15% RH) environment. The reason thereof is assumed as follows.

First, in recent years, in order to realize energy reduction of an image forming apparatus (a copying machine or a printer) I, it is necessary to provide a toner capable of being fixed at a low temperature. A crystalline resin having a low melting pint is used as a method of determining low-temperature fixing properties. In the crystalline resin, since viscosity increases in accordance with an increase in temperature, storability of a toner is low, and thus a countermeasure of using plural kinds of external additives is currently proposed. However, by doing so, since an amount isolated external additive increases and contamination of a surface of an image holding member proceeds, a frictional force of a contact portion of an image holding member and a cleaning blade (hereinafter, also referred to as a "cleaning portion") increases and abrasion of a blade may occur.

Therefore, a technology of containing fatty acid zinc particles together with toner particles has been known. The fatty acid metal salt particles have low surface energy, and accordingly, when the fatty acid metal salt particles approach the cleaning portion, excellent adhesiveness and lubricity are applied to residues of the toner remaining in the cleaning portion (hereinafter, also referred to as a "toner dam"). Therefore, cleaning properties and prevention of blade abrasion are realized.

However, when a toner containing fatty acid zinc particles together with toner particles is used, streak-shaped image defects may be formed, in a case where an image having low image density (for example, equal to or less than 5%) is printed, after images having high image density (for example, equal to or greater than 30%) are continuously printed in a low temperature and low humidity (for example, 10° C. and 15% RH) environment. The reason of the formation of streak-shaped image defects is assumed as follows.

In the charged quantity distribution of toner particles, the toner particles having a large diameter are easily present on a side of low charged quantity and the toner particles having a small diameter are easily present on a side of high charged quantity. In a case where an image is printed in the low temperature and low humidity environment, the charged quantity of the toner particles tends to be increased. Accordingly, in order to prevent a decrease in image density when printing an image having high image density, the low-charged toner particles, that is, toner particle having a large diameter are easily selectively used. Thus, when an image having low image density is printed after printing an image having high image density, the high-charged toner particles having a small diameter are present at a high rate. Since the toner particles having a small diameter easily pass through the cleaning portion (particularly, since toner particles having a small diameter are easily aggregated and pass through the cleaning portion), toner filming may easily occur and streak-shaped image defects may be formed.

Therefore, among the toner particles to the surface of which the fatty acid metal salt particles are attached, the rate of toner particles having a particle diameter equal to or smaller than the volume average particle diameter is set to be from 40% by number to 70% by number with respect to the entirety of toner particles. Accordingly, even when the toner particles having a small diameter approach the cleaning portion at a high rate, the isolated fatty acid metal salt particles are supplied to a toner dam with a sufficient supply amount and the strength of the toner dam is improved. Therefore, toner filming hardly occurs. As a result, formation of streak-shaped image defects is prevented.

Here, a method of setting the rate of toner particles having a particle diameter equal to or smaller than the volume average particle diameter to be from 40% by number to 70% by number with respect to the entirety of toner particles is as follows.

Generally, in a case where a HENSCHEL MIXER is used in externally adding fatty acid metal salt particles, collision energy of the toner particles having a small diameter and fatty acid metal particles is small, and accordingly, an amount of the fatty acid metal particles attached to the toner having a small diameter is relatively smaller than in a case of the toner having a large diameter. Meanwhile, when fatty acid metal salt particles is externally added using a device such as NOBILTA capable of applying a high mechanical load, for example, the collision energy is generally increased. Accordingly, since a mechanical load capable of sufficiently attaching fatty acid metal salt particles to the toner particles having a small diameter is applied, the fatty acid metal salt particles may be controlled to be dispersed and attached substantially in a uniform state, regardless of the particle diameter of the toner particles, and the rate of toner particles having a particle diameter equal to or smaller than the volume average particle diameter may be set to be from 40% by number to 70% by number with respect to the entirety of toner particles.

A number average particle diameter of the fatty acid zinc particles is preferably equal to or smaller than 1.5 μm, because the toner filming is easily prevented. When the number average particle diameter of the fatty acid zinc particles is equal to or smaller than 1.5 μm, the fatty acid zinc particles attached to protrusions of the surface of the toner particles are hardly isolated and a possibility of the isolation of toner particles before the fatty acid metal salt particles approach the cleaning portion decreases. Accordingly, insufficiency of the fatty acid metal salt particles isolated in the toner dam is prevented. That is, the fatty acid metal salt particles moves with the toner particles, until the fatty acid metal salt particles approach the cleaning portion, and are suitably isolated by receiving stress due to the cleaning blade portion. Accordingly, even when the toner particles having a small diameter approach the cleaning portion at a high rate, strength of the toner dam is easily improved. The passing of the toner particles having a small diameter (particularly, passing of the aggregated toner particles having a small diameter) is prevented and toner filming hardly occurs. As a result, the formation of the streak-shaped image defects is prevented.

A ratio (r2/r1) of a long axis r1 and a short axis r2 of the toner particle is preferably set to be from 0.5 to 0.9, because toner filming is easily prevented. When the ratio (r2/r1) is equal to or less than 0.9, collision of toner particles in the toner dam so that the toner particles are densely filled is prevented, and attachment of the fatty acid zinc particles to the toner particles so as to be coated thereon is easily prevented. Accordingly, a deterioration in isolation properties of the fatty acid zinc particles is prevented and insufficiency of the fatty acid zinc particles isolated in the toner dam is prevented. Meanwhile, when the ratio (r2/r1) is equal to or greater than 0.5, the toner particles are flattened and a decrease in strength of the toner dam is prevented. Accordingly, when the ratio (r2/r1) is from 0.5 to 0.9, the strength of the toner dam is easily improved, even when the toner particles having a small diameter approach the cleaning portion at a high rate. The passing of the toner particles having a small diameter (particularly, passing of the aggregated toner particles having a small diameter) is prevented and toner filming hardly occurs. As a result, the formation of the streak-shaped image defects is prevented.

Toner Preparing Method

Next, a method of preparing the toner according to the exemplary embodiment will be described.

The toner according to the exemplary embodiment is obtained by externally adding an external additive to toner particles, if necessary, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Specifically, for example, when the toner particles are manufactured by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (aggregation and coalescence process).

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

Then, the toner according to the exemplary embodiment may be prepared by adding an external additive to the obtained dry toner particles and mixing the materials. The mixing may be performed by using a V blender, a HENSCHEL MIXER, a LÖdige mixer, and the like. Further, if necessary, coarse toner particles may be removed by using a vibration classifier, a wind classifier, and the like.

Electrostatic Charge Image Developer

An electrostatic charge image developer according to the exemplary embodiment is a two-component developer including the toner according to the exemplary embodiment and a carrier.

Carrier

As a carrier, a carrier containing magnetic particles and a resin coating layer coated on a surface of the magnetic particles is used.

Magnetic Particles

Examples of magnetic particles include magnetic metal particles (for example, particles of iron, steel, nickel, or cobalt), magnetic oxide particles (for example, particles of ferrite or magnetite), and dispersion-type resin particles obtained by dispersing these particles in a resin. In addition, particles obtained by causing a resin to infiltrate into porous magnetic particles are also used as the magnetic particles.

Among these, the ferrite particles are preferable as the magnetic particles. As the ferrite particles, ferrite particles represented by the following formula may be used, for example.

Formula: $(MO)_X(Fe_2O_3)_Y$

In the formula, Y represents a value of 2.1 to 2.4 and X represents a value of 3-Y. M represents a metallic element and may contain at least Mn as the metal element.

M contains Mn as a main component, and may use a combination of at least one kind selected from a group consisting of Li, Ca, Sr, Sn, Cu, Zn, Ba, Mg, and Ti (preferably a group consisting of Li, Ca, Sr, Mg, and Ti from the environmental aspect).

The magnetic particles are obtained by magnetic granulating and sintering and the magnetic material may be pulverized as a preprocessing thereof. The pulverization method is not particularly limited and well-known pulverization methods are used, and specifically, a mortar, a ball mill, or a jet mill is used, for example.

Here, the resins contained in the dispersion-type resin particles as the magnetic particles is not particularly limited and examples thereof include styrene resins, acrylic resins, phenolic resins, melamine resins, epoxy resins, urethane resins, polyester resins, and silicone resins. Other components such as a charge-controlling agent or fluorine-containing particles may be further contained in the dispersion-type resin particles as the magnetic particles, according to the purpose.

In the magnetic particles, it is preferable that a mean width with respect to roughness Sm of the surface satisfies a relationship of 1.0 μm≤Sm≤3.5 μm and an arithmetic surface roughness Ra of the surface satisfies a relationship of 0.2 μm≤Ra≤0.7 μm, from a viewpoint of the prevention of occurrence of fogging. In the magnetic particles, it is more preferable that the mean width with respect to roughness Sm of the surface satisfies a relationship of 2.0 μm≤Sm≤3.0 μm and the arithmetic surface roughness Ra of the surface satisfies a relationship of 0.4 μm≤Ra≤0.5 μm, from a viewpoint of the prevention of occurrence of fogging.

When the mean width with respect to roughness Sm of the surface of the magnetic particles is equal to or greater than 1.0 μm and the arithmetic surface roughness Ra thereof is equal to or greater than 0.2 μm, protrusions (projection portions) of the surface of the magnetic particles have a suitable size, and when the resin coating layer is formed, the surface of the resin coating layer (the exposed portion, in a case where the magnetic particles are exposed) easily has a spotted state, rather than a planar state. Meanwhile, when the mean width with respect to roughness Sm is equal to or smaller than 3.5 μm and the arithmetic surface roughness Ra is equal to or smaller than 0.7 μm, an excessively large size of the protrusions (projection portions) of the surface of the resin coating layer (the exposed portion, in a case where the magnetic particles are exposed) is prevented. Therefore, when the fatty acid metal salt particles and the carrier come into contact with each other due to a mechanical load by using protrusions (projection portions) having a suitable size on the surface of the resin coating layer (the exposed portion, in a case where the magnetic particles are exposed), the cleavage of the fatty acid metal salt particles easily occurs. As a result, a coating film of the fatty acid metal salt is easily formed on the surface of the carrier (surface of the resin coating layer) and occurrence of fogging is easily prevented.

A volume average particle diameter of the magnetic particles may be, for example, from 10 μm to 500 μm, and is preferably from 20 μm to 100 μm and more preferably from 25 μm to 60 μm.

The mean width with respect to roughness Sm of the surface of the magnetic particles, the arithmetic surface roughness Ra of the surface, and the volume average particle diameter D50v are values measured by the following method.

First, the coating resin of the carrier which is a measurement target is removed. The specific method thereof is as follows.

20 g of a carrier is put in 100 ml of toluene. Ultrasonic waves are emitted thereto for 30 seconds under the condition of 40 kHz. The magnetic particles and the resin solution are separated using a filtrate selected according to the particle diameter. 20 ml of toluene is allowed to flow to the magnetic particles remaining in the filtrate from the top and washed. Then, the magnetic particles remaining in the filtrate are collected. The collected magnetic particles are put in 100 ml of toluene in the same manner and ultrasonic waves are emitted thereto for 30 seconds under the condition of 40 kHz. The magnetic particles are filtered, washed by 20 ml of toluene, and collected, in the same manner as described above. This operation is performed total 10 times. The magnetic particles finally collected are dried.

Regarding the collected magnetic particles, the mean width with respect to roughness Sm of the surface, the arithmetic surface roughness Ra, and the volume average particle diameter D50v are measured. In a case where the magnetic particles which is a measurement target may be separately determined, In the measurement of the mean width with respect to roughness Sm and the arithmetic surface roughness Ra of the surface of the magnetic particles, a method of determining the values by performing the conversion of the surface with a magnification of 3000 using a super-depth color 3D shape measurement microscope (VK-9500 manufactured by Keyence Corporation) regarding 50 magnetic particles, is used.

For the mean width with respect to roughness Sm, a roughness curve is determined from a three-dimensional shape of the observed surface of the magnetic particles and an average value of intervals of one cycle of a protrusion and a recess determined from an intersection of the roughness curve intersecting with an average line. A reference length when determining the Sm value is 10 μm and a cut-off value is 0.08 mm.

The arithmetic average roughness Ra is determined by determining a roughness curve, adding up absolute values of a deviation between the measurement value and the average value of the roughness curve. A reference length when determining the Ra value is 10 μm and a cut-off value is 0.08 mm.

The measurement of the Sm value and the Ra value are performed based on JIS B0601 (1994).

The volume average particle diameter of the magnetic particles is measured using a laser diffraction-type particle size distribution measuring device "LA-700 (manufactured by Horiba, Ltd.)".

A particle diameter of the pulverized particles or the like during preparing the magnetic particles is also measured in the same manner as described above.

A method of preparing magnetic particles is not particularly limited and the magnetic particles may be prepared as described below, for example.

The magnetic particles may be, for example, suitably prepared by a combination of the following (A) to (E).

(A) Temporary firing is performed before firing.

(B) Pulverization is further performed and granulation is performed from slurry having an adjusted pulverized particle diameter.

(C) $SiO_2$, $SrCO_3$, or the like is used as a surface conditioner.

(D) Temperature and oxygen concentration at the time of firing are adjusted.

(E) A temperature is applied while allowing magnetic particles obtained by the firing to flow.

After performing the temporary firing before the firing, a pulverized particle diameter is controlled. The granulation is performed to obtain a pulverized material having a desired particle size and a volume average particle diameter is determined. A size of a grain boundary which is a base of the magnetic particles is controlled by the pulverized particle diameter after the temporary firing. In addition, roughness of the surface is minutely adjusted and BET specific surface area is obtained using $SiO_2$, $SrCO_3$, or the like as an additive. When $SiO_2$ is added, the area of the grain boundary becomes large and Sm may be adjusted to be large. $SrCO_3$ is operated to increase the Ra.

Then, the firing is performed, the temperature and the oxygen concentration are adjusted, and magnetization is performed to obtain ferrite. The size of the entire grain boundary is adjusted according to the firing temperature and the oxygen concentration. When the firing temperature is high, the Sm increases and when the oxygen concentration is high, the Ra easily increases. In addition, the firing temperature and the oxygen concentration considerably affect resistance and magnetization. As the temperature increases and the oxygen concentration decreases, a degree of magnetization increases and resistance decreases.

After the firing is finished and ferritisation is performed, a size of inner voids is reduced at a temperature at which a ferritisation reaction does not occur. Accordingly, desired magnetic particles are obtained. When a temperature is applied while allowing the particles to flow, a size of voids between the grain boundaries becomes small, and therefore, it is possible to decrease the BET specific surface area without changing Sm and Ra.

Hereinafter, a specific example of a preparing method of magnetic particles will be described, but there is no limitation to materials or numerical values described below, in the preparing method of the magnetic particles.

First, powder of metal oxides or metal salts which are raw materials is mixed with each other and advance firing is performed at a temperature of 900° C. Specifically, a mixture of powder of $Fe_2O_3$, $MnO_2$, $SrCO_3$, and $Mg(OH)_2$ as raw materials is fired at a temperature of 900° C. using a rotary kiln and the metal oxide is set as the raw material. Next, polyvinyl alcohol, water, a surfactant, and a defoamer are added to the obtained fired material and pulverized by a wet-type ball mill until an average particle diameter becomes 2.0 μm. Then, the pulverized material is set in a droplet state using a spray drier to perform drying. The dried particles are fired again at a temperature of 950° C. using a rotary kiln and the containing organic materials are removed at a high temperature. Then, polyvinyl alcohol, water, a surfactant, and a defoamer are added to the dried particles after removing the containing organic materials, and pulverized by a wet-type ball mill until an average particle diameter becomes 5.6 μm. The pulverized material is set in a droplet state again using a spray drier to perform drying. An average particle diameter of the dried particles at this time is set as 40 μm. The dried particles are fired at a temperature of 1300° C. using a rotary kiln. Then, a crushing process and a classification process are performed with respect to the fired material and ferrite particles having an average particle diameter of 35 μm are obtained.

Coating Resin

Examples of the coating resin include an acrylic resin, a polyethylene resin, a polypropylene resin, a polystyrene resin, a polyacrylonitrile resin, a polyvinyl acetate resin, a polyvinyl alcohol resin, a polyvinyl butyral resin, a polyvinyl chloride resin, a polyvinyl carbazole resin, a polyvinyl ether resin, a polyvinyl ketone resin, a vinyl chloride-vinyl acetate copolymer, a styrene-acrylic acid copolymer, a straight silicone resin including an organosiloxane bond or a modified product thereof, a fluororesin, a polyester resin, a polyurethane resin, a polycarbonate resin, a phenolic resin, an amino resin, a melamine resin, a benzoguanamine resin, a urea resin, an amide resin, and an epoxy resin.

In the coating layer, resin particles may be contained in order to control charging or conductive particles may be contained in order to control resistance. The coating layer may contain other additives.

The resin particles are not particularly limited, and resin particles having charge-controlling properties are preferable, and examples thereof include melamine resin particles, urea resin particles, urethane resin particles, polyester resin particles, and acrylic resin particles.

Examples of conductive particles include carbon black, various metal powder, and metal oxides (for example, titanium oxide, tin oxide, magnetite, and ferrite). These may be used alone or in combination of two or more kinds thereof. Among these, carbon black particles are preferable, from effective viewpoints of production stability, cost, and conductivity. The kind of the carbon black is not particularly limited and carbon black having a DBP oil adsorption amount of 50 ml/100 g to 250 ml/100 g is preferable from a viewpoint of excellent production stability.

A coating method using a coating layer forming solution in which a coating resin, and if necessary, various additives are dissolved in an appropriate solvent is used to coat the surface of the magnetic particles with the coating resin layer. The solvent is not particularly limited and may be selected in consideration of the coating resin to be used, coating suitability, and the like.

Specific examples of the resin coating method include a dipping method of dipping magnetic particles in a coating layer forming solution, a spraying method of spraying a coating layer forming solution to surfaces of core materials, a fluid bed method of spraying a coating layer forming solution in a state in which magnetic particles are allowed to float by flowing air, and a kneader-coater method in which magnetic particles of a carrier and a coating layer forming solution are mixed with each other in a kneader-coater and the solvent is removed.

Here, a coating amount of the coating resin layer may be, for example, equal to or greater than 0.5% by weight (preferably, from 0.7% by weight to 6% by weight and more preferably, from 1.0% by weight to 5.0% by weight) with respect to the magnetic particles of the resin coating layer.

When the coating amount of the coating resin layer is equal to or smaller than 6% by weight with respect to the magnetic particles, the surface shape of the carrier is easily maintained as the surface shape (mean width with respect to roughness Sm of the surface and arithmetic surface roughness Ra of the surface) of the magnetic particles.

Here, the coating amount is determined as follows.

In a case of a solvent-soluble coating resin, the weighed carrier is dissolved in a soluble solvent (for example, toluene), magnetic particles are maintained in magnet, and a solution obtained by the coating resin is washed. This operation is repeated several times so that magnetic particles from which the coating resin is removed remain. The magnetic particles are dried, a weight thereof is measured, and a difference is divided by the carrier amount, to calculate the coating amount.

Specifically, 20.0 g of the carrier is measured and put in a beaker, 100 g of toluene is added thereto and stirred using stirring blades for 10 minutes. Toluene is allowed to flow while not allowing the flow of the magnetic particles by attaching the magnet to the bottom of the beaker. This operation is repeated four times, and the beaker after the washing is dried. The amount of the dried magnetic particles is measured and the coating amount is calculated by an expression of [(carrier amount−amount of washed magnetic particles)/carrier amount].

Meanwhile, in a case of a solvent-insoluble coating resin, the heating is performed in a range of room temperature (25° C.) to 1,000° C. under the nitrogen atmosphere and the coating amount is calculated from a decrease in the weight thereof, using THERMO PLUS EVOII differential thermogravimetric analyzer TG 8120 manufactured by Rigaku Corporation.

The mixing ratio (weight ratio) between the toner and the carrier in the two-component developer is preferably from 1:100 to 30:100, and more preferably from 3:100 to 20:100 (toner:carrier).

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member with the electrostatic charge image developer as a toner image, a transfer unit that transfers the toner image formed onto the surface of the image holding member to a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including: charging a surface of an image holding member; forming an electrostatic charge image on the charged surface of the image holding member; developing the electrostatic charge image formed on the surface of the image holding member with the electrostatic charge image developer according to this exemplary embodiment as a toner image; transferring the toner image formed onto the surface of the image holding member to a surface of a recording medium; and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that contains the electrostatic charge image developer according to this exemplary embodiment and is provided with a developing unit is suitably used.

Hereinafter, an example of the image forming apparatus according to this exemplary embodiment will be shown. However, the image forming apparatus is not limited thereto. Main portions shown in the drawing will be described, but descriptions of other portions will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, so that an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that contains the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
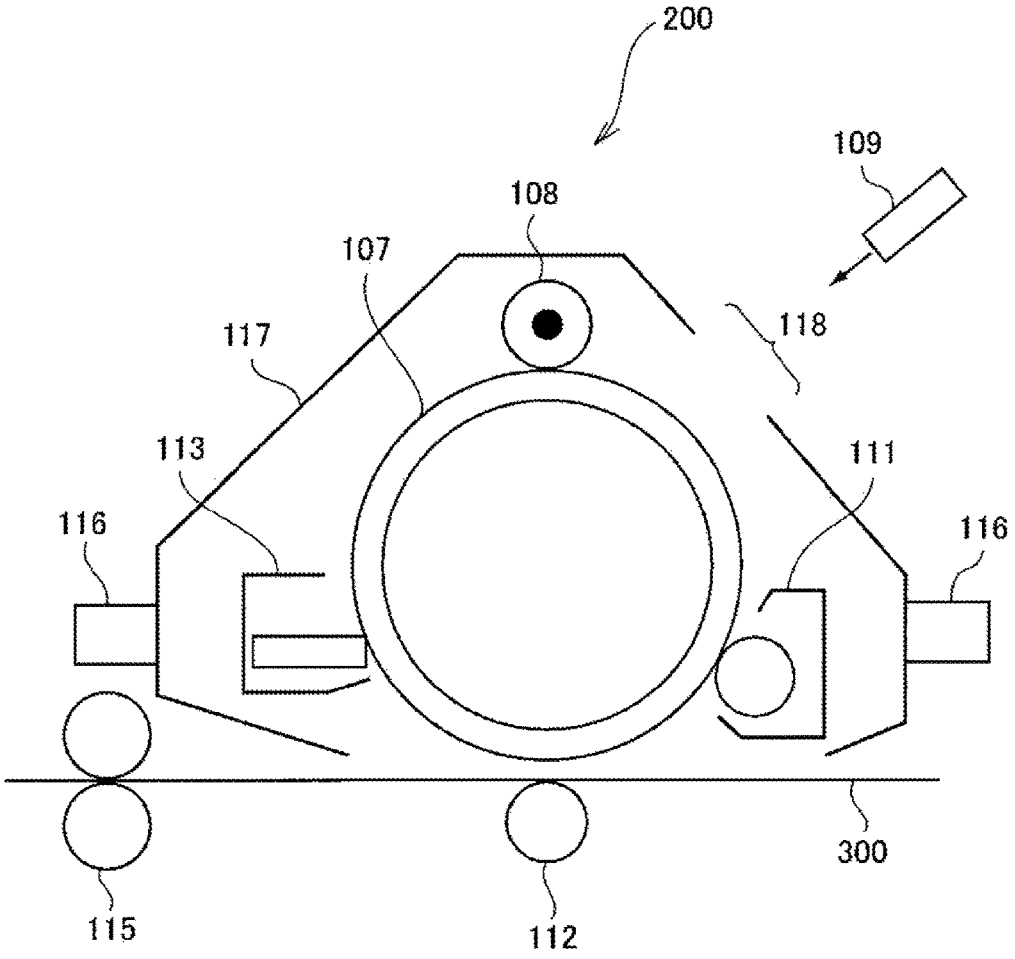
FIG. 2 is a schematic configuration diagram showing a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment contains the toner according to this exemplary embodiment and is detachable from an image forming apparatus. The toner cartridge contains a toner for replenishment for being supplied to the developing unit provided in the image forming apparatus. The toner cartridge may have a container which contains the toner according to this exemplary embodiment.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner contained in the toner cartridge runs low, the toner cartridge is replaced.

EXAMPLES

The exemplary embodiments will be described more specifically with reference to examples and comparative examples, but the exemplary embodiments are not limited to the following examples. Unless specifically noted, "parts" and "%" represent "parts by weight" and "% by weight".

Preparation of Toner Particles

Toner Particles (1)

Preparation of Polyester Resin Dispersion

Ethylene glycol (manufactured by Wako Pure Chemical Industries, Ltd.): 37 parts

Neopentyl glycol (manufactured by Wako Pure Chemical Industries, Ltd.): 65 parts 1,9-nonanediol (manufactured by Wako Pure Chemical Industries, Ltd.): 32 parts Terephthalic acid (manufactured by Wako Pure Chemical Industries, Ltd.): 96 parts The above monomers are put into a flask, heated to a temperature of 200° C. for 1 hours, and after confirming that a reaction system is stirred, and 1.2 parts of dibutyl tin oxide is put thereto. The temperature is increased from the temperature described above to 240° C. for 6 hours while distilling away generated water, and a dehydration condensation reaction is further continued at 240° C. for 4 hours, to obtain a polyester resin A having an acid value of 9.4 mgKOH/g, an weight average molecule weight of 13,000, and a glass transition temperature of 62° C.

Then, the polyester resin A as in a melted state is transferred to CAVITRON CD1010 (manufactured by Eurotec Ltd.) at a rate of 100 parts per minute. A diluted ammonia water having concentration of 0.37% obtained by diluting reagent ammonia water with ion exchange water is put into an aqueous medium tank which is separately prepared, and is transferred to CAVITRON described above at the same time as the polyester resin melted material at a rate of 0.1 liters per min, while heating a heat exchanger at 120° C. CAVITRON is operated under the conditions of a rotation rate of a rotor of 60 Hz and pressure of 5 kg/cm$^2$, and an amorphous polyester resin dispersion in which resin particles having a volume average particle diameter of 160 nm, a solid content of 30%, a glass transition temperature of 62° C., and a weight average molecular weight Mw of 13,000 are dispersed is obtained.

Preparation of Colorant Particle Dispersion

Cyan pigment (C. I. PIGMENT BLUE 15:3 manufactured by Dainichiseika Color & Chemicals Mfg. Co., Ltd.): 10 parts Anionic surfactant (NEOGEN SC manufactured by DKS Co., Ltd.): 2 parts Ion exchange water: 80 parts The above components are mixed with each other, and dispersed by using a high pressure impact type dispersing machine ULTIMIZER (HJP30006 manufactured by SUGINO MACHINE LIMITED) for 1 hour, and a colorant particle dispersion having a volume average particle diameter of 180 nm and a solid content of 20% is obtained.

Preparation of release agent particle dispersion

Paraffin Wax (HNP9 manufactured by Nippon Seiro Co., Ltd.): 50 parts

Anionic surfactant (NEOGEN SC manufactured by DKS Co., Ltd.): 2 parts

Ion exchange water: 200 parts

The above components is heated to 120° C., and sufficiently mixed with each other and dispersed using ULTRA TURRAX T50 manufactured by IKA Works, Inc. The mixture is dispersed using a pressure discharge type homogenizer and a release agent particle dispersion having a volume average particle diameter of 200 nm and solid content of 20% by weight is obtained.

Preparation of Toner Particles (1)

Polyester resin particle dispersion: 200 parts

Colorant particle dispersion: 25 parts

Release agent particle dispersion: 30 parts

Polyaluminum chloride: 0.4 parts

Ion exchange water: 100 parts

The above components are put in a stainless steel flask, sufficiently mixed with each other and dispersed by using ULTRA TURRAX manufactured by IKA Works, Inc. Then, the mixture is heated to 48° C. while stirring the components in the flask in a heating oil bath. After maintaining the mixture at 48° C. for 30 minutes, 70 parts of the same polyester resin as described above is gently added thereto.

Then, after adjusting the pH in the system to 8.0 using a sodium hydroxide solution having concentration of 0.5 mol/L, the stainless steel flask is sealed, a seal of a stirring shaft is magnetically sealed, and the temperature is increased to 90° C. while continuing stirring and maintained for 3 hours. After the reaction ends, the mixture is cooled at a rate of temperature decrease of 2° C./min, filtered, and sufficiently washed with ion exchange water, and a solid-liquid separation is performed by Nutsche-type suction filtration. In addition, the solid content is dispersed again using 3 L of ion exchange water at 30° C., stirred and washed at 300 rpm for 15 minutes. This washing operation is further repeated six times. When the pH of the filtrate is 7.54 and electrical conductivity is 6.5 μS/cm, the solid-liquid separation is performed by Nutsche-type suction filtration using No. 5A filter paper. Next, vacuum drying is continued for 12 hours and toner particles (1) are obtained.

A volume average particle diameter D50v of the toner particles (1) is 5.8 μm and SF1 thereof is 130.

Preparation of External Additives

Preparation of Polishing Agent Particles

Polishing Agent Particles (Ab1) to (Ab3)

After adding the molar quantity of strontium chloride which is equivalent to that of titanium oxide to metatitanic acid slurry, the molar quantity of carbon dioxide gas which is two times of that of titanium oxide is caused to flow at a flow rate of 1 L/min and ammonia water is added. The pH value at this time is 8. The precipitate is washed with water, dried at 110° C. for 24 hours, sintered at 800° C., and mechanically pulverized, and classified, to prepare polishing agent particles (Ab1) formed of strontium titanate particles. By adjusting the pulverization conditions and the classification conditions, polishing agent particles (Ab2) to (Ab3) formed of strontium titanate particles are prepared. The number average particle diameters of the obtained polishing agent particles (Ab1) to (Ab3) are as follows.

Polishing agent particles (Ab1): strontium titanate particles (number average particle diameter of 0.12 μm)

Polishing agent particles (Ab2): strontium titanate particles (number average particle diameter of 4.6 μm)

Polishing agent particles (Ab3): strontium titanate particles (number average particle diameter of 18.0 μm)

Preparation of Fatty Acid Metal Salt Particles

Preparation of Fatty Acid Metal Salt Particles (FM1) to (FM3)

1422 parts of stearic acid is added to 10000 parts of ethanol and mixed at a solution temperature of 75° C., 507 parts of zinc hydroxide is slowly added thereto and stirred and mixed for 1 hour after finishing the adding. After that, the product is cooled at a solution temperature of 20° C. and filtered to remove ethanol and reaction residue, and a solid material is taken out. The solid material is dried using a heating-type vacuum drying machine at 150° C. for 3 hours.

The solid material is taken out from the drying machine and cooled, and a solid material of zinc stearate is obtained.

The obtained solid material is pulverized by a jet mill and classified by an elbow jet classifier (manufactured by MATSUBO Corporation), and fatty acid metal salt particles (FM1) formed of zinc stearate particles are obtained. In addition, by adjusting the pulverization conditions and the classification conditions, fatty acid metal salt particles (FM2) and (FM3) formed of zinc stearate particles are obtained. The number average particle diameters of the obtained fatty acid metal salt particles (FM1) to (FM3) are as follows.

Fatty acid metal salt particles (FM1): zinc stearate particles (number average particle diameter of 0.6 μm)

Fatty acid metal salt particles (FM2): zinc stearate particles (number average particle diameter of 2.0 μm)

Fatty acid metal salt particles (FM3): zinc stearate particles (number average particle diameter of 4.2 μm)

Preparation of Fatty Acid Metal Salt Particles (FM4)

1001 parts of lauric acid is added to 10000 parts of ethanol and mixed at a solution temperature of 75° C., 507 parts of zinc hydroxide is slowly added thereto and stirred and mixed for 1 hour after finishing the adding. After that, the product is cooled at a solution temperature of 20° C. and filtered to remove ethanol and reaction residue, and the solid material is dried using a heating-type vacuum drying machine at 150° C. for 3 hours. The solid material is taken out from the drying machine and cooled, and a solid material of zinc laurate is obtained.

The obtained solid material is pulverized by a jet mill and classified by an elbow jet classifier (manufactured by MATSUBO Corporation), and fatty acidmetal salt particles (FM4) formed of zinc laurate particles having a number average particle diameter of 1.5 μm are obtained.

Preparation of Carrier

Preparation of Magnetic Particles

Magnetic Particles (1)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6.6 parts by weight of polyvinyl alcohol is further added thereto, and pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 1% at 1100° C. for 5 hours. The obtained particles are subjected to a cracking process and a classification process, heated by a rotary kiln under the conditions of 15 rpm and 900° C. for 2 hours, subjected to the classification process in the same manner, and magnetic particles (1) are obtained. A volume average particle diameter D50v (hereinafter, also referred to as "D50v") of the magnetic particles (1) is 35 μm, a mean width with respect to roughness Sm of the surface (hereinafter, also referred to as "Sm") is 2.5, and arithmetic surface roughness Ra of the surface (hereinafter, also referred to as "Ra") is 0.4.

Magnetic Particles (2)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6.6 parts by weight of polyvinyl alcohol is further added thereto, and pulverized and mixed by a wet type ball mill for 6 hours. A volume average particle diameter of the obtained pulverized product is 1.2 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.2% at 1170° C. for 5 hours. The obtained particles are subjected to a cracking process and a classification process, heated by a rotary kiln under the conditions of 15 rpm and 900° C. for 2 hours, subjected to the classification process in the same manner, and magnetic particles (2) are obtained. The D50v of the magnetic particles (2) is 35 μm, the Sm is 1.0, and the Ra is 0.5.

Magnetic Particles (3)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6.6 parts by weight of polyvinyl alcohol is further added thereto, and pulverized and mixed by a wet type ball mill for 3 hours. A volume average particle diameter of the obtained pulverized product is 2.2 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1120° C. for 5 hours. The obtained particles are subjected to a cracking process and a classification process, heated by a rotary kiln under the conditions of 15 rpm and 920° C. for 2 hours, subjected to the classification process in the same manner, and magnetic particles (3) are obtained. The D50v of the magnetic particles (3) is 35 μm, the Sm is 3.5, and the Ra is 0.6.

Magnetic Particles (4)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 7 parts by weight of polyvinyl alcohol is further added thereto, and pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.8% at 1100° C. for 5 hours. The obtained particles are subjected to a cracking process and a classification process, heated by a rotary kiln under the conditions of 15 rpm and 890° C. for 2 hours, subjected to the classification process in the same manner, and magnetic particles (4) are obtained. The D50v of the magnetic particles (4) is 35 μm, the Sm is 2.5, and the Ra is 0.2.

Magnetic Particles (5)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6 parts by weight of polyvinyl alcohol is further added thereto, and pulverized and mixed by a wet type ball mill for 3.5 hours. A volume average particle diameter of the obtained pulverized product is 1.8 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1170° C. for 5 hours. The obtained particles are subjected to a cracking process and a classification process, heated by a rotary kiln under the conditions of 15 rpm and 900° C. for 2 hours, subjected to the classification process in the same manner, and magnetic particles (5) are obtained. The D50v of the magnetic particles (5) is 35 μm, the Sm is 2.5, and the Ra is 0.7.

Magnetic Particles (6)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 7.6 parts by weight of polyvinyl alcohol is further added thereto, and pulverized and mixed by a wet type ball mill for 7 hours.

A volume average particle diameter of the obtained pulverized product is 1.0 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.8% at 1050° C. for 5 hours. The obtained particles are subjected to a cracking process and a classification process, heated by a rotary kiln under the conditions of 15 rpm and 920° C. for 2 hours, subjected to the classification process in the same manner, and magnetic particles (6) are obtained. The D50v of the magnetic particles (6) is 35 μm, the Sm is 0.8, and the Ra is 0.4.

Magnetic Particles (7)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 5.4 parts by weight of polyvinyl alcohol is further added thereto, and pulverized and mixed by a wet type ball mill for 3 hours. A volume average particle diameter of the obtained pulverized product is 2.3 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1120° C. for 5 hours. The obtained particles are subjected to a cracking process and a classification process, heated by a rotary kiln under the conditions of 15 rpm and 900° C. for 2 hours, subjected to the classification process in the same manner, and magnetic particles (7) are obtained. The D50v of the magnetic particles (7) is 35 μm, the Sm is 3.8, and the Ra is 0.6.

Magnetic Particles (8)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6.9 parts by weight of polyvinyl alcohol is further added thereto, and pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.7% at 1160° C. for 5 hours. The obtained particles are subjected to a cracking process and a classification process, heated by a rotary kiln under the conditions of 15 rpm and 920° C. for 2 hours, subjected to the classification process in the same manner, and magnetic particles (8) are obtained. The D50v of the magnetic particles (8) is 35 μm, the Sm is 2.3, and the Ra is 0.1.

Magnetic Particles (9)

1318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and a mixed oxide is obtained by a rotary kiln under the conditions of 20 rpm and 900° C. Then, a dispersing agent and water are added to the mixture, and 6 parts by weight of polyvinyl alcohol is further added thereto, and pulverized and mixed by a wet type ball mill for 5.2 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1150° C. for 5 hours. The obtained particles are subjected to a cracking process and a classification process, heated by a rotary kiln under the conditions of 15 rpm and 890° C. for 2 hours, subjected to the classification process in the same manner, and magnetic particles (9) are obtained. The D50v of the magnetic particles (9) is 35 μm, the Sm is 2.7, and the Ra is 0.8.

Preparation of Coating Solution

Coating Solution (1)

A methyl methacrylate-cyclohexyl methacrylate copolymer (weight ratio of 95:5/Mw of 60,000): 36 parts by weight Carbon black VXC 72 (manufactured by Cabot Corporation): 4 parts by weight Toluene (manufactured by Wako Pure Chemical Industries, Ltd.): 500 parts by weight Isopropyl alcohol (manufactured by Wako Pure Chemical Industries, Ltd.): 50 parts by weight The above components and glass beads (particle diameter: 1 mm, same weight as that of toluene) are put in a sand mill manufactured by Kansai Paint Co., Ltd. and stirred at a rotation rate of 1200 rpm for 30 minutes, to prepare a coating solution (1) having solid content of 11%.

Carriers (1) to (9)

2.0 kg of the magnetic particles (1) are put in a 5 L-sized vacuum degassing type kneader, 340 g of the coating solution 1 is then put therein, the mixture is mixed for 20 minutes while being stirred under the reduced pressure of −200 mmHg at 60° C., and then stirred and dried for 30 minutes at 90° C. and −720 mmHg by increasing the temperature and reducing the pressure, and a carrier (1) is obtained.

Carriers (2) to (9) are obtained in the same manner as described above, except for using the magnetic particles (2) to (9), instead of the magnetic particles (1).

Example 1

0.3 parts of the fatty acid metal salt particles (FM1) is added to 100 parts of the toner particles (1), stirred using NOBILTA (NOBILTA NOB130 manufactured by Hosokawa Micron Corporation) under the conditions of clearance of 0.3, a rotation rate of 2000 rpm, and stirring time of 5 minutes, to externally add the fatty acid metal salt particles (FM1) to the toner particles (1).

0.3 parts of the polishing agent particles (Ab1) and 2.0 parts of silica particles (A200 manufactured by Nippon Aerosil co. Ltd.) are added to the toner particles (1) to which the fatty acid metal salt particles (FM1) are externally added, and these are mixed with each other using a HENSCHEL MIXER at 2000 rpm for 3 minutes to obtain a toner.

The obtained toner (1) and the carrier (1) are put into a V blender at a ratio of toner:carrier=5:95 (weight ratio), and stirred for 20 minutes, to obtain a developer.

Examples 2 to 14 and Comparative Examples 1 to 6

A toner and a developer are obtained in the same manner as in Example 1, except for changing the kind and amount added of the fatty acid metal salt particles, the conditions of stirring performed by NOBILTA, the kind and amount added of the polishing agent particles, and the kind of carrier, according to Table 1.

Measurement of Properties

Regarding the toner of the obtained developer, the rate of fatty acid metal salt-attached toner particles and the strong attachment rate of fatty acid metal salt particles are measured according to the method described above.

Evaluation

Evaluation of color streaks and fogging is performed using the developer obtained in each example. The results are shown in Table 1.

Evaluation of Color Streaks

Evaluation of color streaks is performed as follows.

The obtained developer is kept in the low temperature and low humidity (10° C. and 15% RH) environment for a day.

After that, a developing device of an image forming apparatus "700 DIGITAL COLOR PRESS (manufactured by Fuji Xerox Co., Ltd.)" is filed with the developer and of images having image density (area coverage) of 1% are printed on 100,000 A4-sized sheets in the high temperature and high humidity (28.5° C. and 85% RH) environment.

Regarding the printed images on the 100 sheets from 99,901-st sheet to 100,000-th sheets, the formation of color streaks is visually observed and the number of sheets on which color streaks are caused is counted.

Evaluation criteria are as follows. Acceptable evaluation results are G1 and G2.

Evaluation Criteria

G1: no formation of color streaks

G2: equal to or less than 5 sheets on which color streaks are formed

G3: from 6 sheets to 10 sheets on which color streaks are formed

G4: equal to or greater than 11 sheets on which color streaks are formed

Fogging

Evaluation of fogging is performed as follows.

A developing device of an image forming apparatus, 700 DIGITAL COLOR PRESS (manufactured by Fuji Xerox Co., Ltd.) is filed with the obtained developer and kept in the low temperature and low humidity (10° C. and 15% RH) environment for a day. After that, images having image density (area coverage) of 40% are printed on 100,000 A4-sized sheets in the low temperature and low humidity (10° C. and 15% RH) environment.

Then, the image forming apparatus is kept in the high temperature and high humidity (28.5° C. and 85% RH) environment for a day. After that, images having image density (area coverage) of 40% are printed on 10,000 A4-sized sheets.

Regarding the background portion (non-image portion) on the printed 10,000-th sheet and fogging density is measured by using image densitometer X-RITE 938 (manufactured by X-Rite, Inc.).

Evaluation criteria are as follows. Acceptable evaluation results are G1 and G2.

Evaluation Criteria

G1: fogging density is less than 0.2 and partial fogging is not visually observed.

G2: fogging density is less than 0.2 but slight fogging is visually observed.

G3: fogging density is less than 0.2 but partial fogging is visually observed.

G4: fogging density is equal to or greater than 0.2

TABLE 1

| | Toner | | | | | | | | | | |
|---|---|---|---|---|---|---|---|---|---|---|---|
| | | Fatty acid metal salt particles | | | | | | | | | |
| | Toner particles | | | NOBILTA stirring conditions | | | Polishing agent particles | | Carrier | | |
| | Kind | Kind | Parts | Clearance (mm) | Rotation rate (rpm) | Stirring time (min) | Kind | Parts | Kind | Sm | Ra |
| Example 1 | 1 | FM1 | 0.3 | 0.5 | 2000 | 5 | Ab1 | 0.3 | 1 | 2.5 | 0.4 |
| Example 2 | 1 | FM1 | 0.3 | 0.3 | 3000 | 5 | Ab1 | 0.3 | 1 | 2.5 | 0.4 |

TABLE 1-continued

| | | | | | | | | | | | |
|---|---|---|---|---|---|---|---|---|---|---|---|
| Example 3 | 1 | FM1 | 0.3 | 0.3 | 3000 | 15 | Ab1 | 0.3 | 1 | 2.5 | 0.4 |
| Example 4 | 1 | FM1 | 0.3 | 0.5 | 2000 | 15 | Ab1 | 0.3 | 1 | 2.5 | 0.4 |
| Example 5 | 1 | FM2 | 0.3 | 0.3 | 3000 | 15 | Ab1 | 0.3 | 1 | 2.5 | 0.4 |
| Example 6 | 1 | FM1 | 0.3 | 0.5 | 2000 | 15 | Ab1 | 0.3 | 2 | 1.0 | 0.5 |
| Example 7 | 1 | FM1 | 0.3 | 0.5 | 2000 | 15 | Ab1 | 0.3 | 3 | 3.5 | 0.6 |
| Example 8 | 1 | FM3 | 0.3 | 0.3 | 3000 | 15 | Ab1 | 0.3 | 4 | 2.5 | 0.2 |
| Example 9 | 1 | FM3 | 0.3 | 0.3 | 3000 | 15 | Ab1 | 0.3 | 5 | 2.5 | 0.7 |
| Example 10 | 1 | FM2 | 0.3 | 0.3 | 3000 | 15 | Ab2 | 0.3 | 6 | 0.8 | 0.4 |
| Example 11 | 1 | FM2 | 0.3 | 0.3 | 3000 | 15 | Ab2 | 0.3 | 7 | 3.8 | 0.6 |
| Example 12 | 1 | FM2 | 0.3 | 0.3 | 3000 | 15 | Ab3 | 0.3 | 8 | 2.3 | 0.1 |
| Example 13 | 1 | FM2 | 0.3 | 0.3 | 3000 | 15 | Ab3 | 0.3 | 9 | 2.7 | 0.8 |
| Example 14 | 1 | FM4 | 0.3 | 0.3 | 3000 | 15 | Ab1 | 0.3 | 1 | 2.5 | 0.4 |
| Comparative Example 1 | 1 | FM2 | 0.3 | 0.3 | 1500 | 5 | Ab1 | 0.3 | 1 | 2.5 | 0.4 |
| Comparative Example 2 | 1 | FM2 | 0.3 | 0.5 | 2000 | 3 | Ab1 | 0.3 | 1 | 2.5 | 0.4 |
| Comparative Example 3 | 1 | FM2 | 0.3 | 0.3 | 3000 | 3 | Ab1 | 0.3 | 1 | 2.5 | 0.4 |
| Comparative Example 4 | 1 | FM2 | 0.3 | 0.5 | 1500 | 15 | Ab1 | 0.3 | 1 | 2.5 | 0.4 |
| Comparative Example 5 | 1 | FM2 | 0.3 | 0.5 | 1500 | 3 | Ab1 | 0.3 | 1 | 2.5 | 0.4 |
| Comparative Example 6 | 1 | FM2 | 0.3 | 0.3 | 3000 | 15 | — | 0 | 1 | 2.5 | 0.4 |

| | Particle diameter ratio Df/Dt of fatty acid metal salt particles and toner particles | Rate of fatty acid metal salt-attached toner particles (% by number) | Strong attachment rate of fatty acid metal salt particles (% by number) | Color streaks | Fogging |
|---|---|---|---|---|---|
| Example 1 | 0.01 | 33 | 57 | G1 | G2 |
| Example 2 | 0.01 | 35 | 87 | G1 | G2 |
| Example 3 | 0.01 | 88 | 90 | G1 | G2 |
| Example 4 | 0.01 | 83 | 52 | G2 | G1 |
| Example 5 | 0.35 | 62 | 74 | G1 | G1 |
| Example 6 | 0.01 | 83 | 52 | G2 | G2 |
| Example 7 | 0.01 | 83 | 52 | G2 | G2 |
| Example 8 | 0.72 | 43 | 56 | G1 | G2 |
| Example 9 | 0.72 | 43 | 56 | G1 | G2 |
| Example 10 | 0.35 | 62 | 74 | G1 | G2 |
| Example 11 | 0.35 | 62 | 74 | G2 | G2 |
| Example 12 | 0.35 | 62 | 74 | G2 | G1 |
| Example 13 | 0.35 | 62 | 74 | G2 | G2 |
| Example 14 | 0.26 | 64 | 79 | G1 | G1 |
| Comparative Example 1 | 0.35 | 33 | 45 | G1 | G3 |
| Comparative Example 2 | 0.35 | 25 | 56 | G1 | G3 |
| Comparative Example 3 | 0.35 | 25 | 88 | G1 | G3 |
| Comparative Example 4 | 0.35 | 85 | 43 | G1 | G3 |
| Comparative Example 5 | 0.35 | 24 | 30 | G1 | G4 |
| Comparative Example 6 | 0.35 | 62 | 74 | G4 | G1 |

From the results described above, it is found that, in the examples, occurrence of fogging is prevented when an image is printed in the high temperature and high humidity environment, after images having high image density are continuously printed in the low temperature and low humidity environment, compared to comparative examples.

In addition, it is found that, in the examples, formation of color streaks caused by attachment materials such as discharge products generated from a charging unit is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

an electrostatic charge image developing toner comprising:

a toner particle;

a polishing agent particle; and a fatty acid metal salt particle, wherein a rate of the fatty acid metal salt particles strongly attached to the surface of the toner particles is equal to or greater than 50% by number with respect to the fatty acid metal salt particles attached to the surface of the toner particles; and a carrier containing magnetic particles and a resin coating layer coated on a surface of the magnetic particles, wherein the strong attachment rate is determined by dispersing 10 g of toner in 40 ml of an aqueous solution having 0.2% by weight of a surfactant, stirring the dispersion at 500 rpm for 30 seconds, centrifuging the mixture at 10,000 rpm for 2 minutes to remove a supernatant, and then, drying at 25° C. for 24 hours to obtain a toner subjected to the first pretreatment, and dispersing 10 g of a toner subjected to the first pretreatment in 40 ml of an aqueous solution having 0.2% by weight of a surfactant, subjecting the dispersion to ultrasonic vibration at an output of 60 W and frequency of 20 kHz for 1 hour, after that, the mixture is centrifuged at 10,000 rpm for 2 minutes to remove a supernatant, and then, drying is performed at 25° C. for 24 hours to obtain a toner subjected to the second pretreatment, the toner that is subjected to the first pretreatment and the toner subjected to the second pretreatment are subjected to fluorescence X-ray measurement to measure Net intensity of metal elements contained in the fatty acid metal salt particles, and the strong attachment rate is determined by the formula: ((Net intensity of toner subjected to second pretreatment/Net intensity of toner subjected to first pretreatment)×100).

2. The electrostatic charge image developer according to claim 1, wherein a number average particle diameter of the fatty acid metal salt particles is from 0.5 μm to 3.0 μm.

3. The electrostatic charge image developer according to claim 1, wherein a ratio ($D_f/D_t$) of a number average particle diameter $D_f$ of the fatty acid metal salt particles and a volume average particle diameter $D_t$ of the toner particles is from 0.05 to 1.0.

4. The electrostatic charge image developer according to claim 1, wherein a rate of toner particles of which the fatty acid metal salt particles are attached to a surface is from 30% by number to 90% by number with respect to the entirety of toner particles.

5. The electrostatic charge image developer according to claim 1, wherein a number average particle diameter of the polishing agent particles is from 3 μm to 7 μm.

6. The electrostatic charge image developer according to claim 1, wherein a weight ratio of the fatty acid metal salt particles and a polishing agent particle is from 1:40 to 20:1.

7. The electrostatic charge image developer according to claim 1, wherein a surface of the magnetic particles has a mean width with respect to roughness Sm of from 1.0 μm to 3.5 μm, and an arithmetic surface roughness Ra of from 0.2 μm to 0.7 μm.

8. A toner cartridge comprising:

a container that contains the electrostatic charge image developer according to claim 1, wherein the toner cartridge is detachable from an image forming apparatus.

9. The electrostatic charge image developer according to claim 1, wherein the polishing agent particle is not silicon carbide.

10. The electrostatic charge image developer according to claim 1, wherein the fatty acid metal salt particle is not magnesium stearate.

11. An electrostatic charge image developing toner comprising:

a toner particle;

a polishing agent particle; and a fatty acid metal salt particle, wherein a rate of the fatty acid metal salt particles strongly attached to the surface of the toner particles is equal to or greater than 50% by number with respect to the fatty acid metal salt particles attached to the surface of the toner particles, wherein the polishing agent particle is not silicon carbide, and wherein the strong attachment rate is determined by dispersing 10 g of toner in 40 ml of an aqueous solution having 0.2% by weight of a surfactant, stirring the dispersion at 500 rpm for 30 seconds, centrifuging the mixture at 10,000 rpm for 2 minutes to remove a supernatant, and then, drying at 25° C. for 24 hours to obtain a toner subjected to the first pretreatment, and dispersing 10 g of a toner subjected to the first pretreatment in 40 ml of an aqueous solution having 0.2% by weight of a surfactant, subjecting the dispersion to ultrasonic vibration at an output of 60 W and frequency of 20 kHz for 1 hour, after that, the mixture is centrifuged at 10,000 rpm for 2 minutes to remove a supernatant, and then, drying is performed at 25° C. for 24 hours to obtain a toner subjected to the second pretreatment, the toner that is subjected to the first pretreatment and the toner subjected to the second pretreatment are subjected to fluorescence X-ray measurement to measure Net intensity of metal elements contained in the fatty acid metal salt particles, and the strong attachment rate is determined by the formula: ((Net intensity of toner subjected to second pretreatment/Net intensity of toner subjected to first pretreatment)×100).

12. An electrostatic charge image developing toner comprising:

a toner particle;

a polishing agent particle; and a fatty acid metal salt particle, wherein a rate of the fatty acid metal salt particles strongly attached to the surface of the toner particles is equal to or greater than 50% by number with respect to the fatty acid metal salt particles attached to the surface of the toner particles, wherein the fatty acid metal salt particle is not magnesium stearate, and wherein the strong attachment rate is determined by dispersing 10 g of toner in 40 ml of an aqueous solution having 0.2% by weight of a surfactant, stirring the dispersion at 500 rpm for 30 seconds, centrifuging the mixture at 10,000 rpm for 2 minutes to remove a supernatant, and then, drying at 25° C. for 24 hours to obtain a toner subjected to the first pretreatment, and dispersing 10 g of a toner subjected to the first pretreatment in 40 ml of an aqueous solution having 0.2% by weight of a surfactant, subjecting the dispersion to ultrasonic vibration at an output of 60 W and frequency of 20 kHz for 1 hour, after that, the mixture is centrifuged at 10,000 rpm for 2 minutes to remove a supernatant, and then, drying is performed at 25° C. for 24 hours to obtain a toner subjected to the second pretreatment, the toner that is subjected to the first pretreatment and the toner subjected to the second pretreatment are subjected to fluorescence X-ray measurement to measure Net intensity of metal elements contained in the fatty acid metal salt particles, and the strong attachment rate is determined by the formula: ((Net intensity of toner subjected to second pretreatment/Net intensity of toner subjected to first pretreatment)×100).

* * * * *